United States Patent [19]

Clifford

[11] 4,130,313

[45] Dec. 19, 1978

[54] LIFTING DEVICES

[75] Inventor: David F. Clifford, Walsall, England

[73] Assignee: Ansell Jones & Company Ltd., England

[21] Appl. No.: 765,316

[22] Filed: Feb. 3, 1977

[30] Foreign Application Priority Data

Feb. 3, 1976 [GB] United Kingdom ..... 4135/76

[51] Int. Cl.[2] ..... B66C 1/38

[52] U.S. Cl. ..... 294/83 R

[58] Field of Search ..... 294/83 R, 82, 97, 90, 294/95, 86.2, 83.31, 84, 102; 9/43, 44

[56] References Cited

U.S. PATENT DOCUMENTS 3,416,832 12/1968 Rice ..... 294/83 R 3,661,416 5/1972 Bukarkin et al. ..... 294/83 R 3,853,082 12/1974 Rosenberg et al. ..... 294/83 R

*Primary Examiner*—James B. Marbert

*Attorney, Agent, or Firm*—Dowell & Dowell

[57] ABSTRACT

To enable a lifting element such as a hook to be detached from a pulley block and lowered independently by means of a separate cable the hook is releasably secured to the block through a latch mechanism including a shaft secured to said separate cable and provided with a head member normally supported by a pair of pivoted latch plates which are displaceable into an inoperative position through a linkage system operable by raising the shaft before it is lowered and are subsequently returned to their operative position by return of the shaft to the mechanism.

5 Claims, 6 Drawing Figures

LIFTING DEVICES

BACKGROUND OF THE INVENTION

1. Field of the Invention

This invention relates to lifting devices such as cranes, derricks, winches and hoists of the kind incorporating a pulley block equipped with a lifting hook or other like element.

2. Description of the Prior Art

It has been proposed to render the lifting element, e.g. hook, detachable from the pulley block while suspended by a separate cable to enable the hook alone to be lowered into position and secured to a load to be lifted before the pulley block itself is lowered. In this way the heavy pulley block, when it is lowered, is guided along the hook cable and the hook subsequently is reconnected with the block. This substantially avoids the difficulties and dangers which are otherwise encountered in adverse weather conditions or when the crane and/or the load is not stationary, as for example in transferring loads at sea from one vessel to another or to some fixed installation.

SUMMARY OF THE INVENTION

This invention provides a convenient and safe mechanism for establishing the requisite releasable connection between the hook and the pulley block.

According to the invention we provide a releasable latch mechanism in or for a pulley block for releasably securing a lifting element to the block, the mechanism comprising a shaft having said lifting element at its lower end or means for the attachment of said lifting element and having at its upper end means for the attachment of a lifting cable, a guide allowing longitudinal movement of said shaft by means of said cable and at least one latch plate which is normally engaged beneath an abutment formed or provided on said shaft so that the latter is normaly supported through said latch plate, the arrangement being such that raising said shaft enables said latch plate to move to an inoperative position which allows said shaft to be lowered relative to the guide by means of said cable, and further means being provided to return said latch plate to its operative position.

Preferably a pair of said latch plates are provided on opposite sides of said shaft, and the shaft is formed or provided with a head member the underside of which affords said abutment and normally rests on said latch plates. The latter may, in their operative positions be supported from beneath by part of a body whereby the mechanism is secured to a pulley block or alternatively the mechanism may be built into a pulley block directly.

The latch plates may be mounted for pivotal movement upwardly and outwardly away from one another into their inoperative positions. The latch plates are preferably arranged to be positively displaced into their inoperative positions by upward movement of the shaft relative to the guide prior to downward movement of the shaft. Likewise, they are preferably arranged to be positively displaced back into their operative positions by relative movement between the guide and the shaft in the opposite sense until the head of the shaft is past the latch plates.

BRIEF DESCRIPTION OF THE DRAWINGS

These and other features of the present invention will now be described by way of example with reference to the accompanying drawings wherein.

DESCRIPTION OF THE PREFERRED EMBODIMENTS

Figure 1:
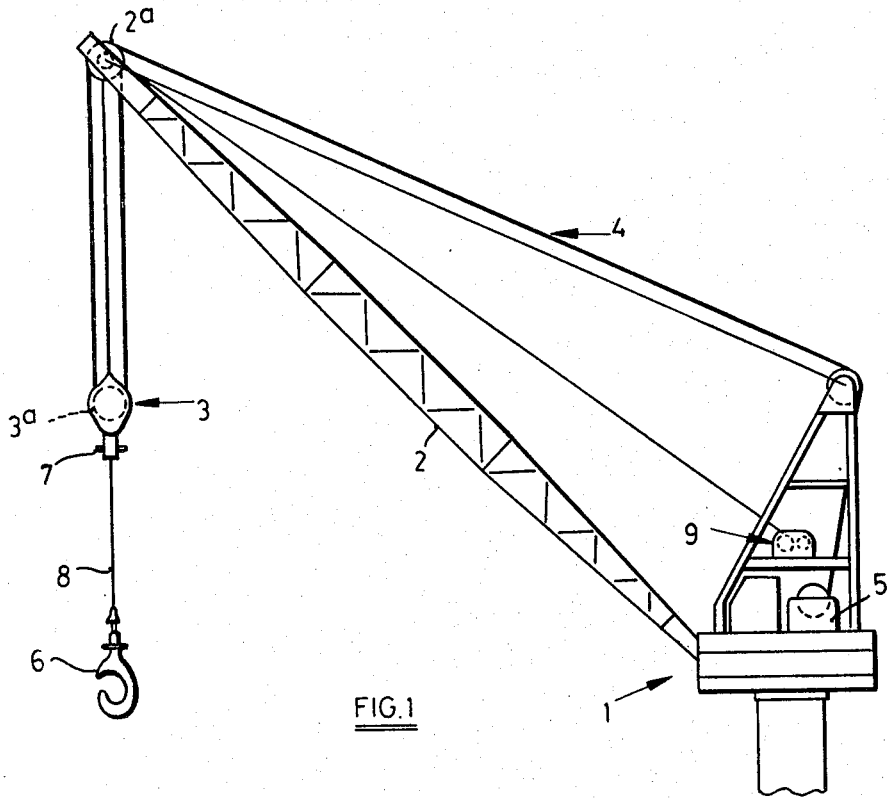
FIG. 1 shows a crane equipped with a hook release mechanism in accordance with the invention.

Referring firstly to FIG. 1, there is shown therein a crane 1 having a jib 2 from which is suspended a conventional pulley block 3 by means of a cable 4 passing over the sheaves 3*a* of the block and over corresponding pulleys 2*a* at the end of the jib. One end of the cable 4 is connected to a main winch 5 in the usual manner for raising and lowering the pulley block 3. Instead of a lifting element, such as hook 6, being permanently carried by the pulley block, the hook 6 is releasably attached to the latter by means of a latch mechanism 7 which is the subject of this invention, and a separate hook cable 8 is provided for raising and lowering by an auxiliary winch 9.

The hook 6 is connected through a shackle 11 to a shaft 10 adapted to be releasably coupled to the pulley block 3 by means of the latch mechanism of the invention.

Alternatively the shaft 10 could be formed as a shank integral with the hook. At its upper end the shaft 10 is formed or provided with a domed head 14 having a flat underface 15. A clevis 16 is secured to the head and serves as the attachment point for the hook cable 8.

Figure 2:
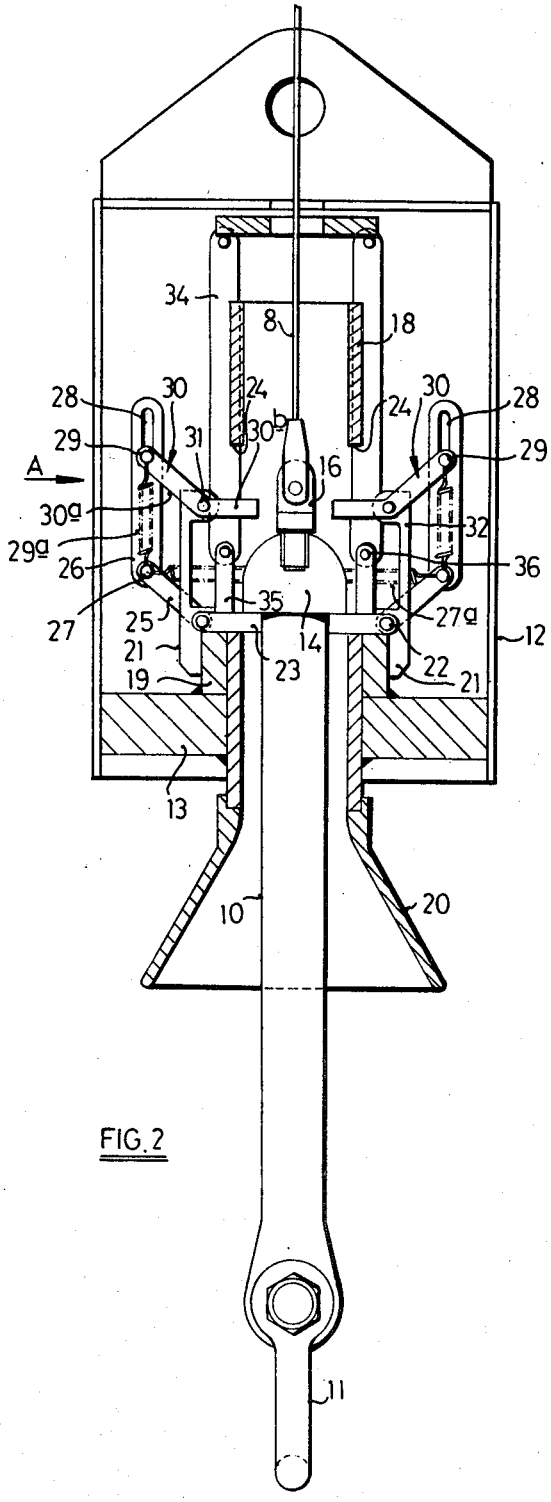
FIGS. 2 and 3 show one embodiment of such mechanism in vertical sections, with the working parts respectively in an operative position with a hook shaft engaged and in an inoperative position with the hook shaft disengaged.

A heavy base 13 carries a vertical guide tube 18 located within a collar 19 and extending downwardly through a central aperture in the base. At its lower end the tube 18 carries a lead-in cone 20. The collar 19 is provided with two opposed pairs of lugs 21 on which a pair of latch plates 23 are pivotally mounted by means of a pin 22 and normally, as shown in FIG. 2, the plates 23 rest on the upper edge of the collar 19 and on the lower edges of openings 24 formed in the guide immediately above the collar. As can be seen, the head 14 of the shaft, rests on the latch plates. As can be seen in FIG. 2 the latch plates themselves are supported from beneath by the lower edge of the opening 24 and by the collar 19 which serves as an abutment member to transmit the load imposed on the latch plates 23 by the head 14 directly to the base 13 and not through the pivot pin 22. The shaft is thus effectively supported by the base 13 which is itself supported from the pulley block 3 through a body 12 which has attachment plates at its upper end for this purpose.

Figure 3:
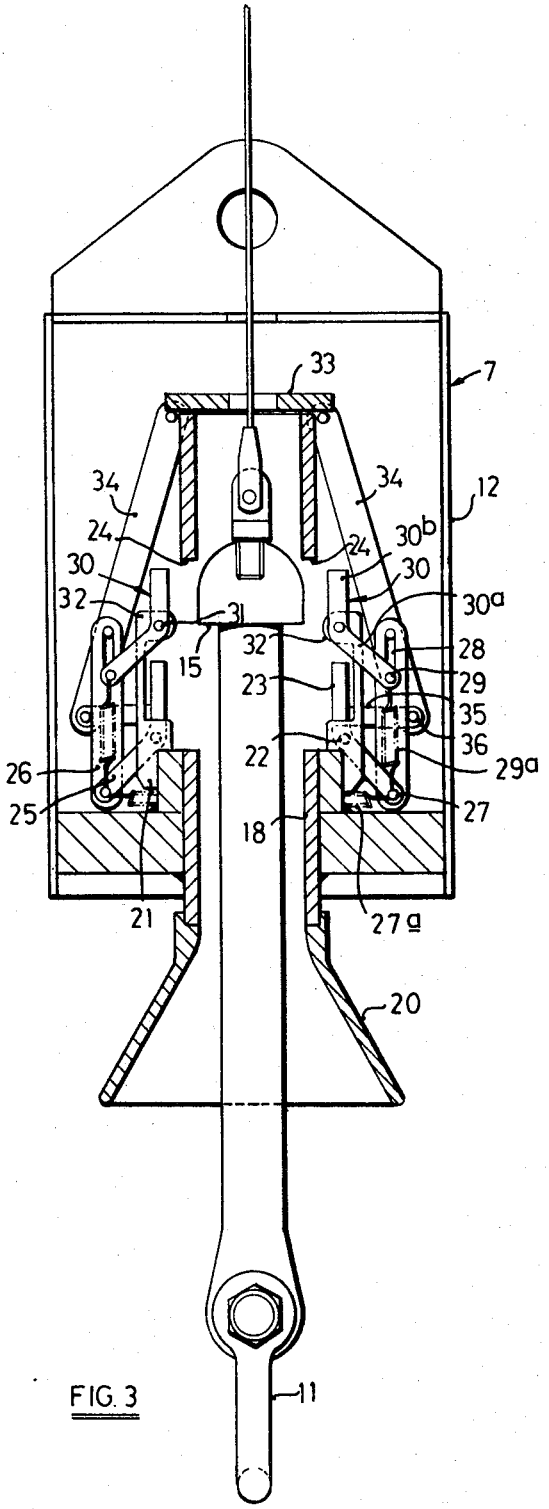

To enable the latch plates to be positively displaced into inoperative positions in which, as shown in FIG. 3, they are disposed vertically outside the tube 18, each plate 23 is connected with a linkage system and for this purpose provided with a pair of parallel arms 25 rigidly secured thereto and projecting outwardly. Each such arm 25 is pivotally connected to a respective vertical link 26 by means of a pair of pins 27 which extend parallel to one another on opposite sides of the guide tube 18. Each link 26 at its upper end is in turn pivotally connected through a lost motion linkage comprising slot 28 and pin 29 to a bell-crank lever 30 itself pivotally supported on a pin 31 carried by upward extensions 32 of the lugs 21. As can be seen the outer arm **30*a* of the lever 30 extends parallel to the arm 25 and the inner arm 30*b* extends parallel to the latch plate 23** and above the latter.

The latch plates 23 are displaced to their inoperative positions by raising the shaft 10 by means of the hook cable 8 until the domed head 14 engages the inner arms **30*b* of the levers 30, thus pivotting them outwardly about the pins 31 and thereby forcing the links 26 downwardly. This in turn raises the latch plates 23 to the position shown in FIG. 3. The pins 27 extend outwardly beyond the edges of the latch plates and are interconnected by a pair of tension springs 27*a*, so that as the arms 25 pivot downwardly they pass through an overcentre condition in which the springs 27*a*** reach maximum extension, and continued movement is assisted by said springs.

The hook 6 may then be lowered freely by means of the hook cable 8 and the auxiliary winch 9.

When the hook 6 is safely engaged on the load to be lifted, the main winch 5 of the crane 1 can be operated to lower the pulley block 3 and attachment mechanism 7 along the hook cable 8 to the hook 6. The cone 20 guides the tube 18 onto the shaft 10. At this stage the latch plates 23 are in their inoperative positions as shown in FIG. 3. This allows the tube 18 to be lowered until the head 14 of the shaft engages a flat plate 33, which then rests on the upper end of the tube. The plate 33 carries two pairs of pivotally dependent links 34 which at their lower ends are pivotally connected by pins 36 to respective further arms 35 rigidly secured to the latch plates 23 so as to project perpendicularly therefrom.

Thus continued lowering of the tube 18 causes the plate 33 to be displaced relatively upward by the head of the shaft. This action lifts the links 34 and thus causes the latch plates 23 to be pivoted inwardly, initially against the action of the spring **27*a* carried by the pins 27 but subsequently with the assistance of such springs. In this way the latch plates 23 and the inner arms 30*b* of the levers 30 are returned to their operative positions as shown in FIG. 2**.

Raising the pulley block by means of cable 4 and the main winch 5 now lifts the tube 18 relative to the shaft 10 so bringing the latch plates up towards the underface 15 of the head 14 of the shaft 10. As the head engages the inner arms **30*b* of the levers 30, these are allowed to pivot downwardly due to the lost motion linkages formed by slots 28 and pins 29. Thereafter the head 14 engages the latch plates 23** and the load connected to the hook may be raised by continued lifting of the block as a whole by means of the main winch of the crane.

The levers 30 are returned to their operative positions to enable subsequent release of the hook by means of tension springs **29*a* acting between the pins 27 and pins 29 parallel thereto which interconnect each pair of pivots at the outer ends of the levers 30**.

If the attachment is intended for use with a pulley block having an odd number of sheaves it is necessary to provide guide pulleys to deflect the hook cable 8 laterally instead of, as shown, allowing it to pass centrally from the attachment at the upper end thereof.

Figure 5:
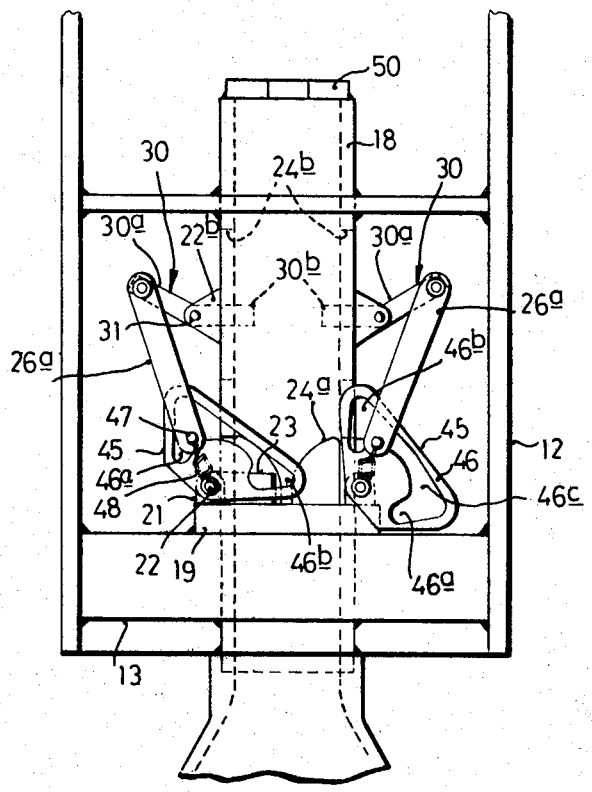
FIG. 5 shows a fragmentary view in side elevation of a modified embodiment.

In the modification shown in FIG. 5 a simplified linkage system is employed. As before the latch plates 23 are pivoted to lugs 21 carried by the collar 19 and bell-crank levers 30 are arranged above the plates, in this case supported on separate lugs **22*b* attached to the guide tube 18. Instead of the arms 35, each latch plate 23 carries, at one side of the tube 18, a cam plate 45 affording a generally U-shaped cam track 46 including end portions 46*a* and 46*b*, which extend substantially radially with respect to the axis about which the latch is displaceable, and an arcuate portion 46*c*. The outer arm 30*a* of lever 30 is pivoted directly to the upper end of a dependent link 26*a* (instead of through a lost motion connection as to link 26) and the link 26*a* carries at its lower end a cam follower peg 47 which engages the cam track 46. A tension spring 48 acts between the peg 47 and the pivot 22** of the latch plate.

In operation, raising the shaft 10 causes the head 14 to lift the inner arms **30*b* of the levers 30 as before. This pushes down the peg 47, which is engaged in the end part 46*a* of the cam track, and displaces the cam plate 45 and the latch plate 23 outwardly from the position shown at the left-hand side of FIG. 5 to the inoperative position shown at the right-hand side thereof so that the shaft 10** may be lowered.

Figure 6:
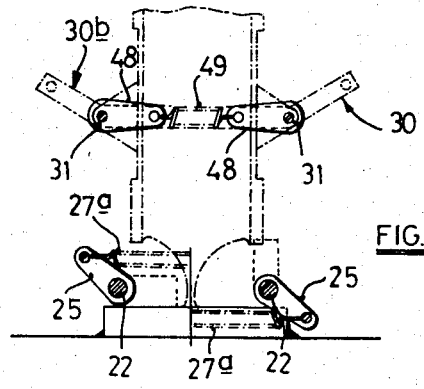
FIG. 6 shows a section of the FIG. 5 modification in a plane parallel to the FIG. 5 view.

As can be seen in FIG. 6, the pins 22 on which the latch plates 23 are mounted each carry a single arm 25 on the side of the guide tube 18 opposite to that at which the cam plates 45 are provided and such arms are, as before, interconnected by a tension spring **27*a* for the same purpose. Further, above the arms 25, the pins 31 on which the levers 30 are mounted each carry a further arm 48 extending parallel to the inner arm 30*b* and the these arms 48 are interconnected by a tension spring 49**.

When the latch plates 23 are displaced into their inoperative positions as shown at the right-hand side of FIG. 5, the spring **27*a* holds them in this position while the spring 49 returns the levers 30 to the positions shown in which the inner arms 30*b* extend into the guide tube 18. In doing so, the peg 47 on the link 26*a* follows the inner edge of the cam track 46 and enters the opposite end part 46*b* thereof as shown at the right-hand side of FIG. 5**.

When the shaft 10 is lowered, the underface 15 of the head 14 engages the inner arms **30*b* of the levers 30 and forces them downwardly to lift the links 26*a*. The spring 49 returns the levers 30 to the position shown and the springs 48 return the links 26*a* to the position shown at the right-hand side of FIG. 5**.

When the shaft subsequently re-enters the guide tube 18, the head 14 lifts the inner arms **30*b* of the levers 30 and drives the links 26*a* downwardly and the pegs 47 are driven downwardly along the end portions 46*b* of the tracks so as to return the cam plates 45 and the latch plates 23 to their original positions. Thereafter, when the pulley block is raised the inner arms 30*b* of the levers 30 are forced downwardly by the underface of the head 14 so as to lift the links 26*a*. The pegs 47 are thus lifted from the end portions 46*b* of the cam tracks and returned to the other end portions 46*a* as shown at the left hand side of FIG. 5** ready to displace the latch plates to their inoperative positions again.

To ensure correct operation of the mechanism, a plate 50 is secured to the upper end of the guide tube 18, the hook cable 8 passing through a central aperture therein, and the head 14 is so dimensioned in the vertical direction that when it engages the fixed plate 50 its underface 15 is clear of the levers 30 thus allowing the inner arms **30*b* to return to the positions shown in FIG. 5**.

Figure 4:
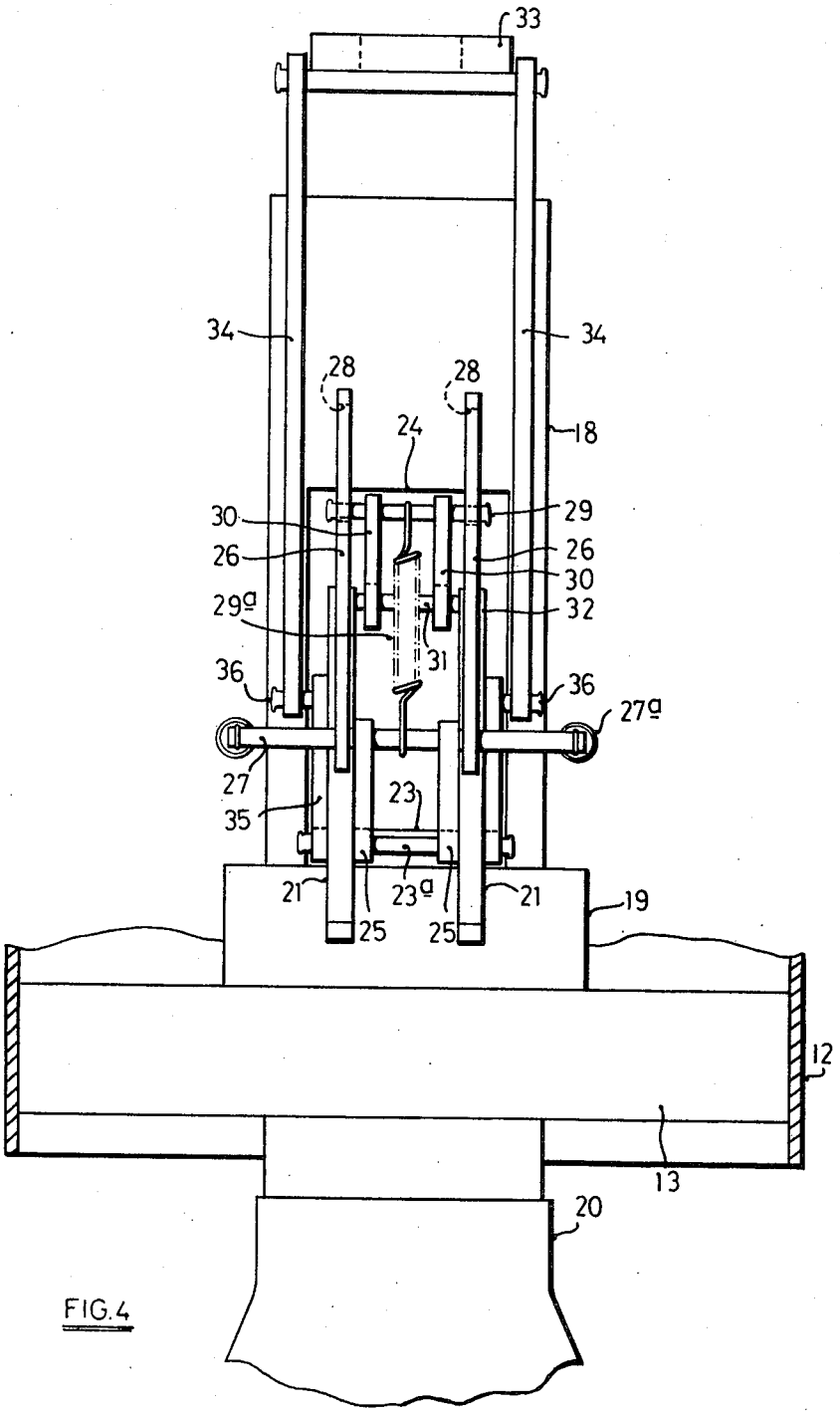
FIG. 4 shows a fragmentary view in the direction of arrow A in FIG. 2, omitting the hook shaft for clarity.

In the modification shown in FIG. 5 the guide tube 18 is formed with two pairs of openings **24*a* and 24*b* respectively for the latch plates 23 and for the levers 30 instead of a single pair of larger openings 24 as in FIGS. 2 to 4**.

I claim:

1. In or for a pulley block, a latch mechanism for releasably securing a lifting element to the block comprising:

(a) a shaft having said lifting element at its lower end or means for the attachment of said lifting element, and having at its upper end a head member affording a downwardly presented abutment face and means for the attachment of a lifting cable;

(b) a vertical guide member having an open lower end through which said shaft can be moved longitudinally by means of said lifting cable;

(c) pivotally mounted latches carried by said guide member having an operative condition in which said latches extend into the guide member to engage the abutment face of said shaft and an inoperative condition in which said latches are withdrawn to allow downward passage of the shaft relative to said guide member;

(d) release means for displacing said latches from the operative condition to the inoperative condition comprising pivoted arms carried by the guide member at a position above the latches and linkage means connecting said pivoted arms and the latches for moving the latches to the inoperative condition in response to upward movement of the shaft relative to the guide member to bring the head member into contact with the pivoted arms; and (e) means for restoring said latches to the operative condition.

2. A mechanism as claimed in claim 1 wherein the linkage means includes spring means for releasably holding the latches in the operative condition and in the inoperative condition.

3. A mechanism as claimed in claim 2 wherein said means restoring said latches to the operative condition comprises a displaceable member extending in the path of travel of the head member of the shaft at a position above said pivoted arms so as to be raised by engagement with the head member of the shaft, said linkage means also being coupled to said displaceable member for positively restoring the latches to the operative condition in response to raising of the displaceable member so that the head member may then be lowered relative to the guide member to engage its abutment face on said latches.

4. A mechanism as claimed in claim 3 wherein said linkage means also provides for return of said pivoted arms to positions in which they project into the path of travel of the head member of the shaft when said latches are restored to the operative condition, and lost motion means are provided for allowing said pivoted arms to be displaced downwardly against resilient means by the head member of the shaft without causing displacement of said latches.

5. In or for a pulley block, a latch mechanism for releasably securing a lifting element to the block comprising:

(a) a shaft having said lifting element at its lower end or means for the attachment of said lifting element, and having at its upper end a head member affording a downwardly presented abutment face and means for the attachment of a lifting cable;

(b) a vertical guide member having an open lower end through which said shaft can be moved longitudinally by means of said lifting cable;

(c) pivotally mounted latches carried by said guide member having an operative condition in which they extend into the guide member to engage the abutment face of the shaft and an inoperative condition in which they are withdrawn to allow downward passage of the shaft relative to the guide member: and (d) means for displacing said latches from the operative condition to the inoperative condition in response to upward movement of the shaft relative to the guide member by means of said lifting cable and for thereafter restoring the latches to the operative condition so as to enable the shaft to be lowered out of the guide member and subsequently re-engaged therein, said means comprising pivoted arms carried by the guide member at a position above the latches and movable upwardly and downwardly by contact with the head member of the shaft, cam members carried by the respective latches, respective links supported from said pivoted arms, cam followers carried by said links and engaging said cam members, first spring means acting upon said pivoted arms for maintaining the latter in positions in which they project into said guide member except when positively displaced from such positions by engagement with said head member, and second spring means for releasably holding the latches in the operative condition and in the inoperative condition, each cam member affording a generally U-shaped cam track having first and second end portions which extend generally radially with respect to an axis about which the respective latch is pivoted and so shaped that when the latches are in the operative condition initial upward movement of said pivoted arm by contact with the head member due to an initial upward movement of the shaft relative to the guide member causes the cam followers while engaged in the first end portions of the cam tracks to displace the cam members in such a direction as to displace the latches to the inoperative condition, subsequent downward movement of the pivoted arm by the abutment face of the head member due to lowering of the shaft relative to and out of the guide member causes the cam followers to move to the second end portions of the cam track without displacing the cam members, subsequent upward movement of the pivoted arms by contact with the head member due to re-entry of the shaft into the guide member causes the cam followers while engaged in the second end portion of the cam tracks to displace the cam members in such a direction as to restore the latches to the operative condition, and further downward movement of the pivoted arms by the abutment face of the head member due to lowering of the shaft relative to the guide member to engage the abutment face with the latch plates causes the cam followers to move back to the first end portions of the cam tracks.

* * * * *